United States Patent [19]

Mahaney

[11] Patent Number: 5,007,258

[45] Date of Patent: Apr. 16, 1991

[54] BOX LOCK ASSEMBLY

[75] Inventor: John C. Mahaney, Rutland, Mass.

[73] Assignee: Olson Manufacturing Co., Holden, Mass.

[21] Appl. No.: 525,736

[22] Filed: May 18, 1990

[51] Int. Cl.[5] ..... B65D 55/14

[52] U.S. Cl. ..... 70/159; 70/34

[58] Field of Search ..... 70/158, 159, 160, 161, 70/162, 163, 164, 165-173, 63, 32, 33, 34

[56] References Cited

U.S. PATENT DOCUMENTS 4,120,182 10/1978 Michelman ..... 70/63

4,158,953 6/1979 Nielsen ..... 70/164

*Primary Examiner*—Robert L. Wolfe

*Attorney, Agent, or Firm*—Samuels, Gauthier & Stevens

[57] ABSTRACT

A lock assembly for preventing unauthorized opening of a utility meter box cover. The assembly includes a lock housing detachably mounted to a box side wall by a fastener which is accessible from the box interior. A post is shiftable in a passageway extending through the lock housing between an operative position overlapping the cover and a retracted position clear of the cover. A barrel lock is removably received in the lock housing to prevent shifting of the post from its operative to its inoperative position.

13 Claims, 2 Drawing Sheets

BOX LOCK ASSEMBLY

BACKGROUND OF THE INVENTION

1. Field of the Invention

This invention relates generally to electric meter boxes and other like utility equipment enclosures, and is concerned in particular with an improved tamper resistant lock assembly for use in preventing unauthorized access to the interiors of such boxes.

2. Description of the Prior Art

It is known to provide locks with flat angled flanges designed to overlap and prevent unauthorized opening of meter box covers. Various embodiments of such locks are described, for example, in U.S. Pat. Nos. 4,751,831 (Morris et al.); 4,475,365 (Swisher); 4,474,041 (Finck); 4,254,647 (Finck); 4,144,729 (Nielsen); and 1,343,851 (Roe).

These known locks suffer from a number of problems and disadvantages, not the least of which is the succeptability of their flat angled flanges to bending, prying or cutting. Other problems include the difficulty of machining and assembling such locks, which often translates into unacceptably high costs.

Among the objectives of the present invention is the provision of an improved lock assembly which is highly tamper resistant, which because of its simple design is easy to machine and assemble, and is thus capable of being manufactured more efficiently and at a lower cost as compared to prior art designs.

SUMMARY OF THE INVENTION

This invention relates to an improved lock assembly for preventing the unauthorized opening of the cover of a utility meter box or other like enclosure. The lock assembly includes a housing which is detachably secured to the exterior of a side wall of the box by a fastener which is accessible from the interior of the box. The housing has a head portion which protruding the level of the cover to define a lock chamber intersected by a first passageway. A post is received in the first passageway for selective movement between an operative position overlapping the closed cover to prevent unauthorized opening thereof, and an inoperative position clear of the closed cover to permit its opening in order to gain access to the interior of the box. The post has a second passageway extending therethrough. When the post is in its operative position, the second passageway is aligned with the lock chamber. A barrel lock is removably received in the lock chamber to extend through the thus aligned second passageway and thereby prevent movement of the post from its operative position to its inoperative position.

Preferably, the post is provided with a shoulder arranged to abut the cover when the second passageway is aligned with the lock chamber. The lock chamber advantageously constitutes a longitudinally extending blind bore having a drainage passageway communicating therewith at the bottom thereof.

In one of the embodiments to be described hereinafter in greater detail, the post is preferably provided with retention means at its opposite ends to prevent its disassembly from the housing.

Other objects, features and advantages of the present invention will be described in greater detail with reference to the accompanying drawings, wherein:

DESCRIPTION OF ILLUSTRATED EMBODIMENTS

Figure 1:
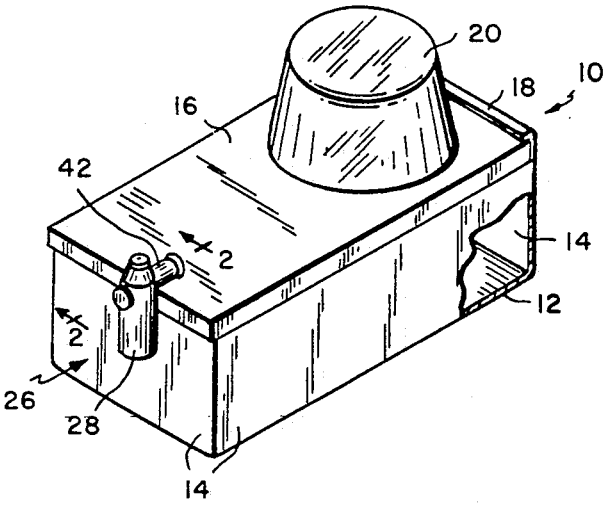
FIG. 1 is a perspective view of a utility meter box having its cover held in a closed position by a lock assembly in accordance with the present invention.
Figure 2:
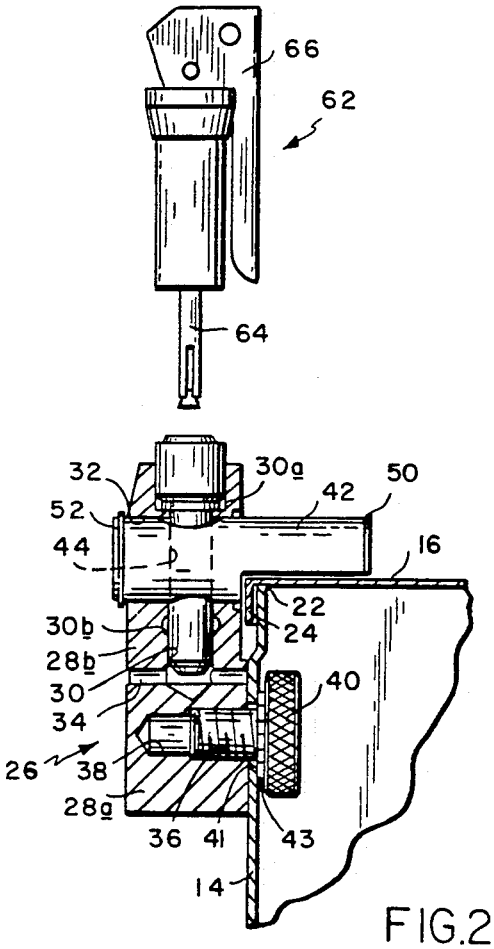
FIG. 2 is a sectional view on an enlarged scale taken along line 2—2 of FIG. 1, with a key used to remove the barrel lock depicted above the lock assembly.
Figure 3:
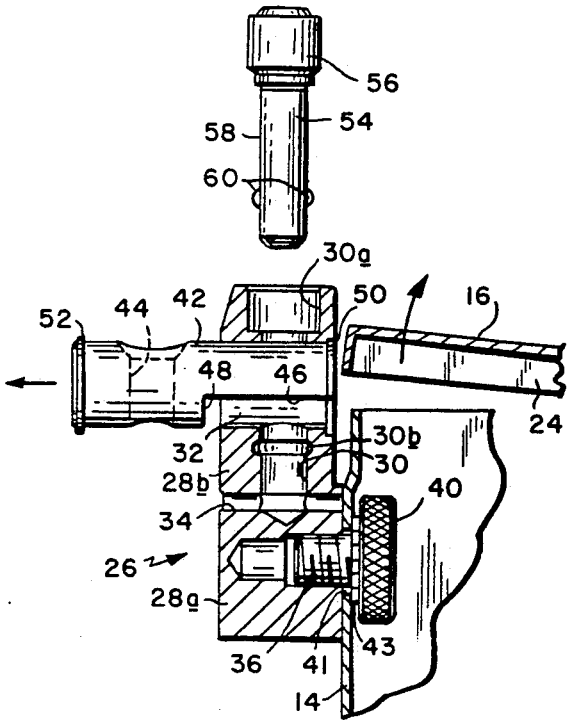
FIG. 3 is a view similar to FIG. 2 showing the barrel lock removed and the post shifted to its inoperative position in order to permit opening of the box cover.

Referring initially to FIGS. 1–3, a conventional electric meter box is shown at 10. The box includes a bottom wall 12, a side wall 14, and a cover 16. The rear edge of the cover underlies and is captured beneath a horizontal lip 18 formed integrally on the rear panel of the side wall. The box contains an electric meter (not shown) having a glass dome 20 protruding through an opening in the cover 16.

As can be best seen in FIG. 2, the cover 16 is preferably dimensioned to overlap the top edge of the side wall 14 as at 22, with a peripheral lip 24 arranged to surround the top edge of the side wall when the cover is in the closed position.

The lock assembly of the present invention is generally depicted at 26. The lock assembly includes a housing 28 having a base portion **28*a* and a head portion 28*b*. The head portion 28*b* defines a lock chamber 30 intersected by a through first passageway 32. The housing is preferably machined from cylindrical bar stock, with the lock chamber 30 consisting of a blind bore drilled axially and extending longitudinally from the top of the housing, and with a drilled drainage passageway 34 communicating with the bottom thereof. The lock chamber 30 is provided with an enlarged diameter portion 30*a* at its upper end, and with an internal circular groove 30*b* at a location between the first passageway 32 and a drainage passageway 34**.

The base portion **28*a* of the housing is adapted to be detachably secured to an exterior surface of the side wall 14 by means of a screw 36 threaded into an enlarged diameter portion of a blind bore 38. The passageways 32 and 34 and the blind bore 38 are drilled into the housing and extend in parallel relationship to each other. The screw 36 is provided with an enlarged diameter knurled head 40 accessible exclusively from the interior of the box 10. The screw extends through a punched hole 41 in the box side wall, with a lock washer 43 preferably being interposed between the screw head 40 and the interior surface of the side wall 14**.

When the housing 28 is thus detachably secured to the side wall 14, its head portion **28*b* protrudes above the level of the closed cover 16**.

A post member 42 is received in the first passageway 32 for selective movement between an operative position overlapping the closed cover 16, as shown in FIG. 2, and an inoperative position clear of the closed cover to permit opening thereof, as shown in FIG. 3. The post member is conveniently machined from cylindrical bar stock, and is provided with a second passageway 44 extending therethrough. The underside of the post member is notched to provide a flat surface 46 and a perpendicular shoulder 48 (see FIG. 3). In addition, the post member is preferably provided at one end with a raised lip 50 and at the other end with a groove containing a snap ring 52.

During assembly, the post member 42 is inserted through the first passageway 32 from right to left as viewed in FIGS. 2 and 3, after which the snap ring 52 is mounted in place. This results in the post member being captivated in the first passageway 32.

When the post member is shifted to its operative position as shown in FIG. 2, the flat surface 46 lies flush over the top surface of the closed cover 16, and the perpendicular shoulder 48 abuts the peripheral cover lip 24. Contact between the shoulder 48 and the lip 24 occurs when the second passageway 44 is aligned axially with the lock chamber 30. A barrel lock 54 is then axially inserted into the lock chamber 30 and the aligned second passageway 44 of the post member 42. The barrel lock 54 is of a type well known to those skilled in the art, as shown for example in U.S. Pat. No. 4,712,395, the disclosure of which is herein incorporated by reference in its entirety. The barrel lock has an enlarged head 56 and a cylindrical smaller diameter shank 58 with circumferentially spaced openings through which locking balls 60 partially protrude as a result of their being urged radially outwardly by an internal spring loaded plunger (not shown). When the barrel lock is inserted into the mutually aligned lock chamber 30 and second passageway 44, its enlarged head 56 is received in the upper portion 30*a* of the lock chamber, and its locking balls 60 engage within the internal groove 30*b*. When thus received, the shank 58 of the barrel lock acts in "double shear" to prevent the post member 42 from being shifted from its operative to its inoperative position.

A key 62, which again may be of the type disclosed in U.S. Pat. No. 4,712,395, may be employed to extract the barrel lock 54 from the lock assembly and thereby free the post member 42 for shifting to its inoperative position. The key includes a stem which is received in the barrel lock 54, and which is operated by a pivotal handle 66 to withdraw the internal plunger and thereby free the locking balls 60 for retraction into the shank 58. This in turn frees the barrel lock for axial retraction from the lock housing.

In light of the foregoing, those skilled in the art will now appreciate that the present invention offers a number of important advantages. For example, both the post member 42 and the housing 28 ar machined from cylindrical bar stock. The majority of the machining operations are performed on screw machines where dimensional variations are easily compensated for. The secondary drilling and broaching procedures are also easily adjustable. Thus, the overall design of the lock assembly is ideally suited to accommodate a wide variation of sizes and potential applications.

Once the hole 41 is punched into the box side wall, installation of the lock assembly on the meter box is thereafter accomplished without the use of additional hand tools. The large knurled screw head 40 is easy to grasp and readily accessible from the interior of the box, and its combination with the lock washer 43 allows for more than adequate torque application in order to securely attach the lock body to the box side wall.

The post member 42 is conveniently captured for shiftable movement between its operative and inoperative positions. As a result of its being machined from cylindrical stock, the thickness, shape and hardness of the post member can be selected to resist bending, prying or cutting without unduly increasing its overall weight.

The lock assembly is designed to accept a standard barrel lock 54. The lock shank 58 extends completely through the second passageway 44 in the post member to thereby act in "double shear" to resist withdrawal of the post member from its operative position.

Figure 4:
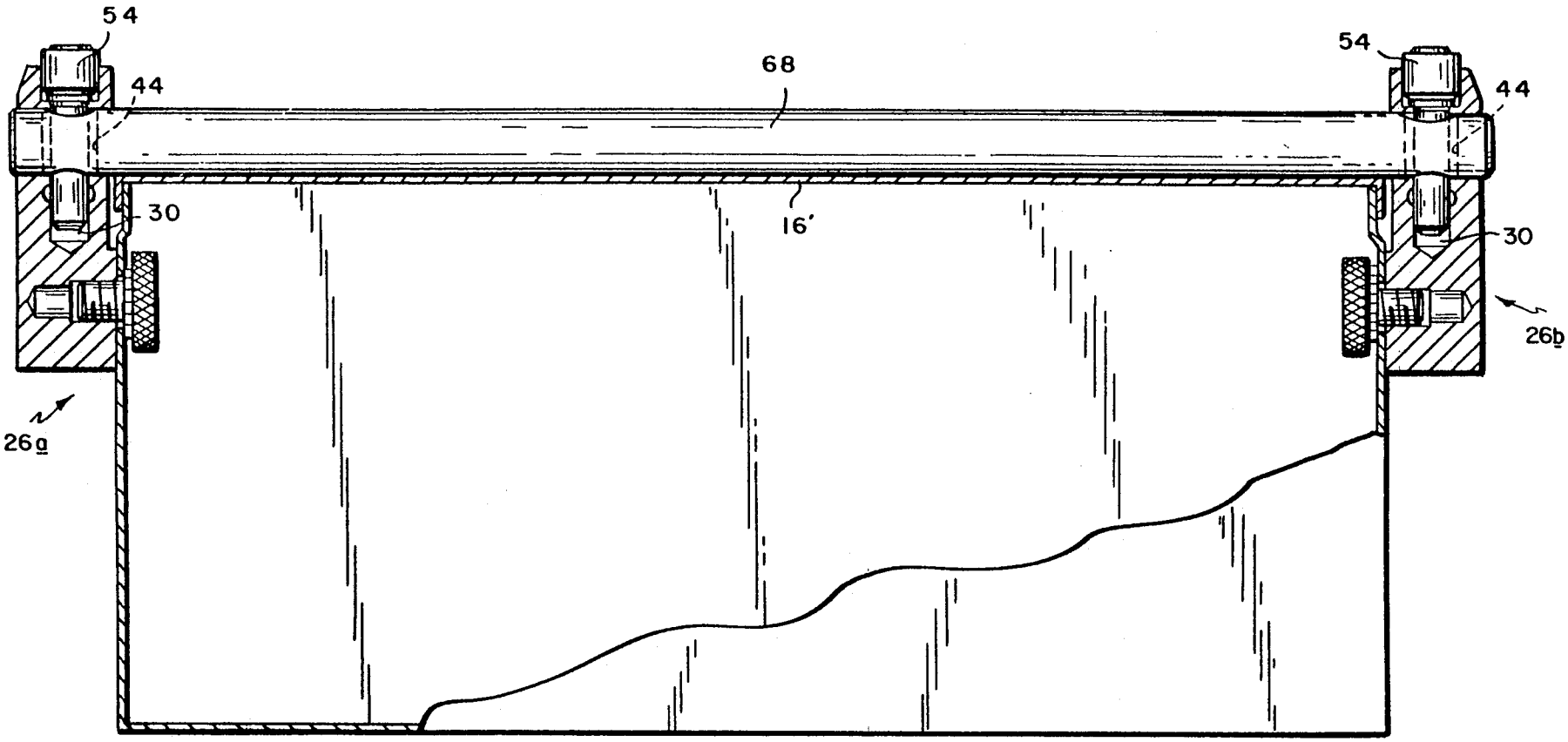
FIG. 4 is a sectional view taken through another utility box and showing an alternate embodiment of the invention.

The invention is adaptable for uses and applications other than as illustrated in FIGS. 1–3. For example, and as shown in FIG. 4, when securing the covers of larger transformer cabinets or the like, it may be necessary to employ multiple lock assemblies indicated generally at 26*a* and 26*b*. The lock assemblies 26*a*, 26*b* are largely identical in design and construction to the lock assembly 26 illustrated in FIGS. 1–3, with the exception that a common longer bar 68 is substituted for the individual captivated post members 42. The bar member 68 is adapted to overlie the cover 16, and its opposite ends are provided with through passageways 44 which coact with the lock chambers 30 and barrel locks 54 in the same manner as previously described.

I claim:

1. For use in combination with an electric meter box or other like enclosure having a base wall, a side wall, and a cover which may be opened to gain access to the interior of the box, and which when closed, overlaps said side wall and prevents such access, a lock assembly for maintaining said cover in its closed position, said lock assembly comprising:

a housing having a base portion and a head portion, said head portion defining a lock chamber intersected by a through first passageway;

means accessible from the interior of said box for securing said base portion to the exterior of said side wall at a location such that said head portion protrudes above the level of the closed cover;

a post member having a second passageway extending therethrough, said post member being receivable in said first passageway for selective movement between an operative position at which said post member overlaps the closed cover to prevent opening thereof and said second passageway is aligned with said lock chamber, and an inoperative position at which said post member is clear of the closed cover to permit opening thereof; and a barrel lock removably receivable in said lock chamber to extend through the thus aligned second passageway to thereby prevent movement of said post member from said operative position to said inoperative position.

2. The lock assembly of claim 1 wherein said post member is provided with a shoulder arranged to abut said cover when said second passageway is aligned with said lock chamber.

3. The lock assembly of claim 1 wherein said lock chamber constitutes a longitudinally extending blind bore having a drainage passageway communicating therewith at the lower end thereof.

4. The lock assembly of claim 3 wherein said first passageway and said drainage passageway extend in parallel relationship.

5. The lock assembly of claim 1 wherein said means for securing said base portion comprises a screw extending through a hole in said side wall for engagement with threaded hole in said base portion.

6. For use in combination with an electric meter box or other like enclosure having a base wall, a side wall, and a cover which may be opened to gain access to the interior of the box, and which when closed, overlaps said side wall and prevents such access, a lock assembly for maintaining said cover in its closed position, said lock assembly comprising:

a housing having a base portion and a head portion, said head portion having a longitudinally extending blind bore defining a lock chamber, said lock chamber being intersected by a first passageway extending through said head portion;

means accessible from the interior of said box for securing said base portion to the exterior of said side wall, with said head portion protruding above the level of the closed cover;

a post member having a second passageway extending therethrough, said post member being receivable in said first passageway for selective movement between an extended position abutting said cover, with one end of said post member overlapping the closed cover to prevent opening thereof and with said second passageway being aligned coaxially with said lock chamber, and a retracted position at which the said one end of said post member is clear of the cover to permit opening thereof; and a barrel lock removably receivable in said lock chamber to extend through the thus aligned second passageway and to thereby prevent movement of said post member from said extended position to said retracted position.

7. For use in combination with an electric meter box or other like enclosure having a base wall, a side wall, and a cover which may be opened to gain access to the interior of the box, and which when closed, overlaps said side wall and prevents such access, a lock assembly for maintaining said cover in its closed position, said lock assembly comprising:

a housing having a base portion and a head portion, said head portion defining a lock chamber intersected by a through first passageway;

means for securing said base portion to the exterior of said side wall with said head portion protruding above the level of the closed cover;

a post member having a second passageway extending therethrough, said post member being receivable in said first passageway for selective movement between an operative position at which said post member overlaps the closed cover to prevent opening thereof and said second passageway is aligned with said lock chamber, and an inoperative position at which said post member is clear of the closed cover to permit opening thereof;

retention means at the opposite ends of said post member for preventing removal of said post member from said first passageway; and a barrel lock removably receivable in said lock chamber to extend through the thus aligned second passageway to thereby prevent movement of said post member from said operative position to said inoperative position.

8. The lock assembly of claim 7 wherein the retention means at one end of said post member comprises a snap ring received in a groove in said post member.

9. The lock assembly of claim 8 wherein the retention means at the other end of said post member comprises a raised lip.

10. The lock assembly of claim 7 wherein said lock chamber comprises a longitudinally extending blind bore, and wherein said first passageway intersects said blind bore at a location spaced from the bottom thereof.

11. The lock assembly of claim 10 wherein said barrel lock is provided with spring loaded balls adapted to coact in engagement with an internal groove in said blind bore, said internal groove being located between said first passageway and the bottom of said blind bore.

12. For use in combination with an electric meter box or other like enclosure having a base wall, a side wall, and a cover which may be opened to gain access to the interior of the box, and which when closed, overlaps said side wall and prevents such access, a lock assembly for maintaining said cover in its closed position, said lock assembly comprising:

a housing having a base portion and a head portion, said head portion defining a lock chamber intersected by a through first passageway;

means for securing said base portion to the exterior of said side wall with said head portion protruding above the level of the closed cover;

a post member machined from cylindrical stock and having a second passageway extending therethrough, said post member being receivable in said first passageway for selective movement between an operative position at which said post member overlaps the closed cover to prevent opening thereof and said second passageway is aligned with said lock chamber, and an inoperative position at which said post member is clear of the closed cover to permit opening thereof; and a barrel lock removably receivable in said lock chamber to extend through the thus aligned second passageway to thereby prevent movement of said post member from said operative position to said inoperative position.

13. The lock assembly of claim 12 wherein said housing is machined from cylindrical stock.

* * * * *